US005967651A

United States Patent [19]

Neumann et al.

[11] Patent Number: 5,967,651

[45] Date of Patent: Oct. 19, 1999

[54] LOW-BEAM HEADLIGHT FOR A VEHICLE WITH SAME REFLECTOR USED FOR DIFFERENT SITUATIONS

[75] Inventors: Rainer Neumann, Stuttgart; Henning Hogrefe, Walddorfhaeslach; Ralf Steinhart, Reutlingen, all of Germany

[73] Assignee: Robert Bosch Gmbh, Stuttgart, Germany

[21] Appl. No.: 08/799,237

[22] Filed: Feb. 14, 1997

[30] Foreign Application Priority Data

Mar. 20, 1996 [DE] Germany ..... 196 10 904

[51] Int. Cl.[6] ..... F21M 3/12

[52] U.S. Cl. ..... 362/538; 362/520

[58] Field of Search ..... 362/538, 520, 362/516, 329, 327

[56] References Cited

U.S. PATENT DOCUMENTS

| | | | |
|---|---|---|---|
| 4,699,032 | 10/1987 | Lietar et al. | 362/538 |
| 4,964,021 | 10/1990 | Masin | 362/538 |
| 5,215,368 | 6/1993 | Neumann | 362/520 |
| 5,264,993 | 11/1993 | Neumann et al. | 362/516 X |
| 5,461,553 | 10/1995 | Neumann et al. | 362/516 X |
| 5,526,248 | 6/1996 | Endo | 362/538 |
| 5,636,917 | 6/1997 | Furami et al. | 362/538 |

FOREIGN PATENT DOCUMENTS

3341773A1 5/1984 Germany .

*Primary Examiner*—Laura K. Tso
*Attorney, Agent, or Firm*—Michael J. Striker

[57] ABSTRACT

The low-beam headlight has a reflector, in which a light source is mounted and a light-permeable disk which has optical elements. Light from the light source is reflected as a light beam by the reflector which would illuminate a region (62) of a measuring screen (60) placed in front of the headlight so that the region (62) has a horizontal light-dark boundary without being effected by or without action of the light-permeable disk. A first part of the light beam reflected by the reflector illuminates a first part **(64*a*,64*b*) of the screen under boundary lines (65*a*,65*b*) inclined relative to the light-dark boundary (63). A second part of the light beam reflected by the reflector illuminates a second part (66) of the measuring screen between the light-dark boundary (63) and the boundary lines (65*a*,65*b*)**. A portion of the first part of the light beam is at least partially deflected by the optical elements of the light-permeable disk so that it produces the higher lying section of the light-dark boundary associated with the vehicle's own traffic side of the light beam from the low-beam headlight after passing through the disk.

11 Claims, 3 Drawing Sheets

LOW-BEAM HEADLIGHT FOR A VEHICLE WITH SAME REFLECTOR USED FOR DIFFERENT SITUATIONS

BACKGROUND OF THE INVENTION

The present invention relates to a low-beam headlight for a vehicle.

A low-beam headlight is described in German Patent document DE 33 41 773 A1. This low-beam headlight has a reflector, a light source and a light-permeable disk arranged in the path of the light rays reflected from the reflector. The light-permeable disk has at least one localized optical element, by which the light beam reflected from the reflector is deflected or guided during its passage through it. The light beam issuing from the low-beam headlight has an asymmetrical upper light-dark boundary with an approximately horizontal section directed toward the on-coming traffic side of the vehicle. It also has another section directed toward the side of the vehicle opposite the on-coming traffic side which is arranged at least somewhat higher than the portion directed at the on-coming traffic. The reflector is formed in such a way that a first part of the light beam reflected from a first part of the reflector produces both portions of the light-dark boundary without action of the light-permeable disk. The part of the light beam reflected from the remaining portion of the reflector should pass under the light-dark boundary necessarily by action of the optical elements of the light-permeable disk. The light-dark boundary which the light beam from the low-beam headlight has cannot remain the same for all traffic situations, but must be different for different situations, because of the varying legal regulations in different countries or different types of traffic, which means right-hand traffic and left-hand traffic. Different embodiments of the reflector and the disk are required for different situations with the known low-beam headlight. This requires comparatively large manufacturing costs, since a special manufacturing tool is required for each embodiment of the reflector and also large assembly and logistic expenses are required in order for the embodiment of the reflector required for this application to be maintained.

SUMMARY OF THE INVENTION

It is an object of the present invention to provide an improved low-beam headlight of the above-described type, which does not have the above-described disadvantages.

According to the invention the low-beam headlight for a vehicle comprises a reflector, a light source and a light-permeable disk arranged in the path of light rays from the light source reflected by the reflector, which has at least one optical element whereby the light beam issuing from the low-beam headlight has an asymmetric light-dark boundary with a section directed toward an on-coming traffic side and another section directed to its own traffic side, i.e. the traffic side of the vehicle opposite the on-coming traffic side, so that the section of the light-dark boundary on its own traffic side is at least partially higher than that on the on-coming traffic side. The reflector has means for reflecting light from the light source as a light beam having an approximately horizontal light-dark boundary on a measuring screen arranged in front of the low-beam headlight without action of the light-permeable disk and the at least one optical element of the light-permeable disk comprises means for at least partially deflecting a part of the light beam reflected from the reflector so that it forms the section of the light-dark boundary on its own traffic side.

The low-beam headlight according to the invention has the advantage that for different situations in which different behavior of the light-dark boundary is required the same form for the reflector can be used so that manufacturing expenses for the low-beam headlight are reduced and furthermore the assembly and logistics expenses can be minimized. Because of the invention the reflector is formed so that it reflects a light beam with an approximately horizontal light-dark boundary and so that a part of the light beam is deflected by optical elements of the disk so that it produces the portion of the light-dark boundary of the light beam from the low-beam headlight directed toward its traffic side. Comparatively similar optical elements are sufficient for this effect of the disk so that the making of the different disks for different situations is not substantially expensive in comparison to the current state of the art.

Advantageous features and embodiments of the low-beam headlight according to the invention are presented in the appended dependent claims.

In one embodiment the means for reflecting light forms two first parts of the light beam on opposite sides of a vertical plane containing an optic axis of the reflector and extending at least approximately symmetrically to the vertical plane and the means for at least partially deflecting of the light-permeable disk deflects only one of the two first parts of the light beam to produce the section of the light-dark boundary associated with the traffic side of the vehicle opposite to the on-coming traffic side. The features of this embodiment allow selective production of the first parts of the light beam to form that portion of the light-dark boundary directed toward its own traffic side.

In another preferred embodiment the reflector has a first reflector part by which first parts of the light beam are reflected so as to illuminate a first part of the measuring screen having a boundary line at least partially extending below and spaced from the horizontal light-dark boundary without action of the light-permeable disk. The reflector also has a second reflector part by which a second part of the light beam is reflected which illuminates a second part of the measuring screen bordering the horizontal light-dark boundary without action of the light-permeable disk.

Because of these features a sufficiently high illumination intensities are guaranteed under both portions of the light-dark boundary. Moreover a simple structure of the optical elements of the disk is possible.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
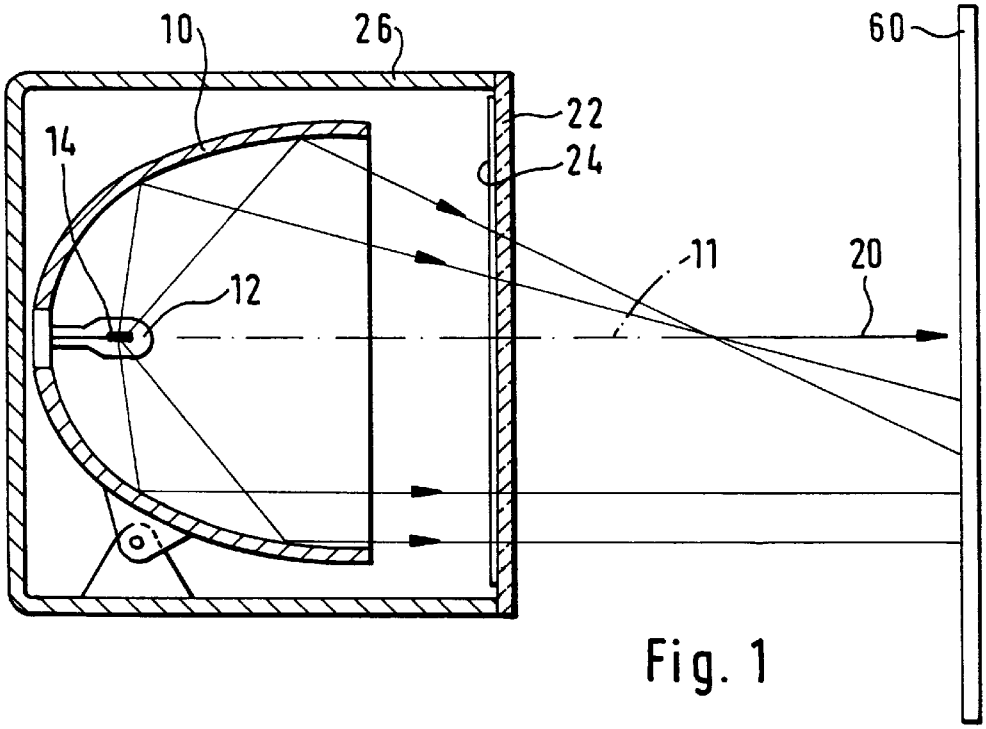
FIG. 1 is a simplified vertical cross-sectional view through a low-beam headlight according to the invention.
Figure 2:
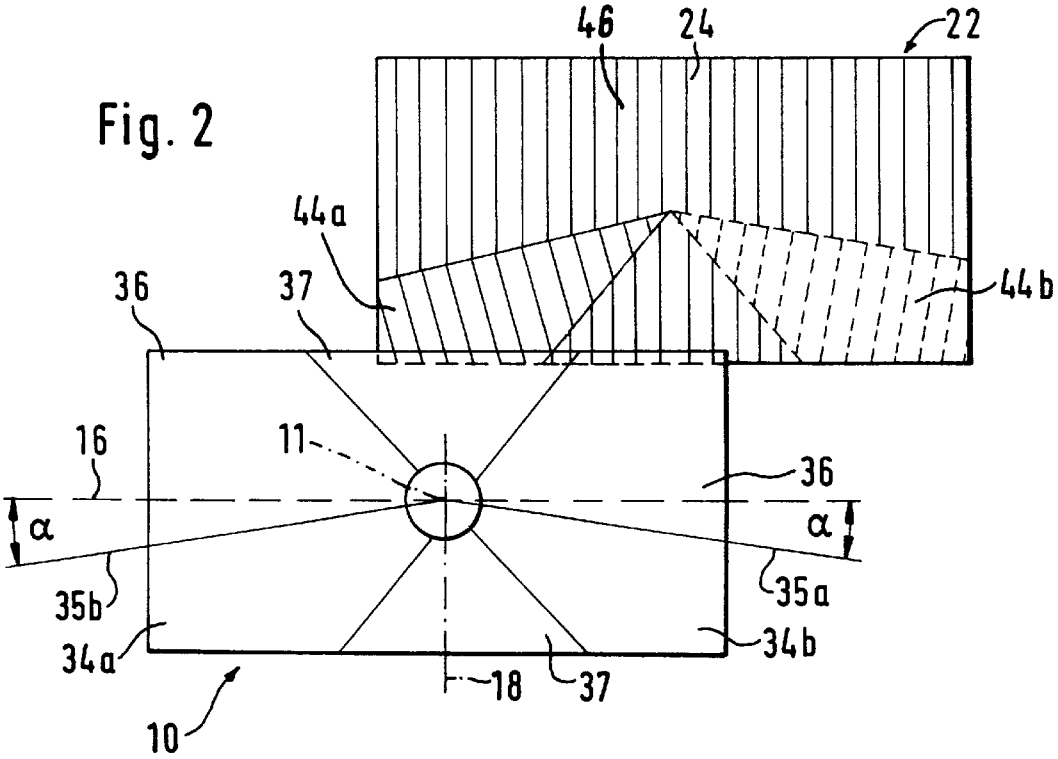
FIG. 2 is a rear view in the light propagation direction of a first embodiment of the low-beam headlight.
Figure 5:
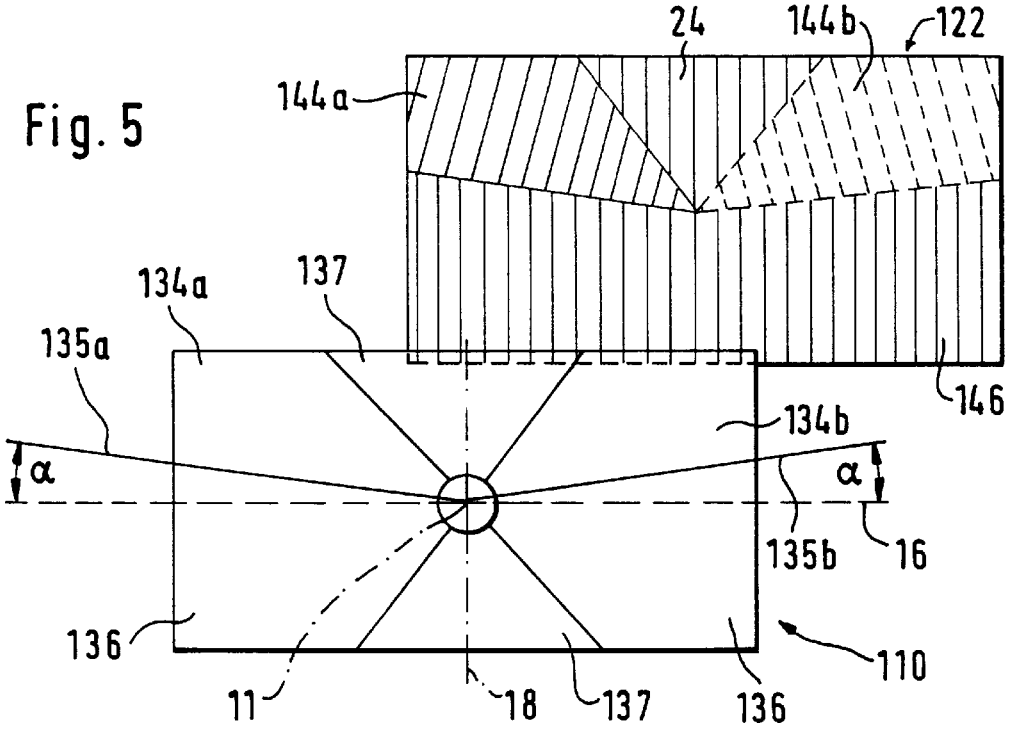
FIG. 5 is a rear view of a second embodiment of the low-beam headlight according to the invention.

A low-beam headlight for a vehicle, especially a motor vehicle, shown in FIGS. 1, 2 and 5, has a reflector 10 in which a light source 12 is inserted or mounted in the vicinity of its peak. The reflector 10 can be made of sheet metal or plastic. A gas discharge lamp or an incandescent lamp can, for example, be used as a light source 12, whose light emitting body 14, which means the filament in the case of an incandescent lamp and/or the glowing arc in the case of the gas discharge lamp, extends approximately parallel or transverse to the optic axis 11 of the reflector. The reflector 10 has one of its optic axes 11 in a horizontal plane 16 and in a vertical plane 18. A light-permeable disk 22 which is made from glass or plastic is arranged downstream of the reflector in the light propagation direction 20 in the path of light rays of the light beam reflected from the reflector 10. The light-permeable disk 22 has at least one localized optical element 24 which can be formed like a lens and/or prism. The light-permeable disk 22 can at the same time act as the cover disk closing the low-beam headlight from the outside or can be arranged additionally the cover disk closing the headlamp. The reflector 10 can be arranged in the housing 26 which is mounted in the vehicle, or can be mounted on a retaining frame, which is similarly attached to the vehicle.

Figure 3:
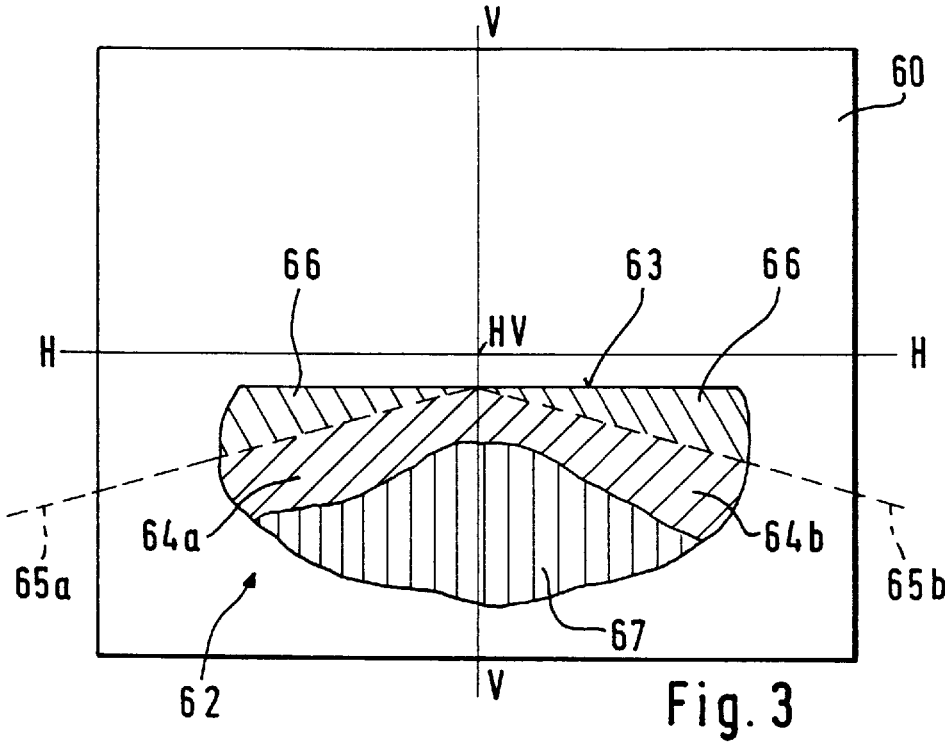
FIG. 3 is a diagrammatic plan view of a pattern of light formed by a reflected light beam reflected from the reflector of the headlight on a measuring screen arranged in front of the low-beam headlight.

FIG. 3 shows a measuring screen 60 arranged perpendicular to the optic axis 11 and spaced from a low-beam headlight in front of it. The screen represents the projection of a road in front of the headlight which is accordingly illuminated by it. The horizontal central plane of the measuring screen 60 is designated with HH and the vertical central plane is designed with VV in FIG. 3. The horizontal central plane HH and the vertical central plane VV intersect at the point HV of the measuring screen 60. The extension of the optic axis 11 runs through the point HV. Light issuing from the light source 12, more exactly from its light emitting body 14, is reflected by the reflector as a concentrated light beam, which has a light-dark boundary prior to emerging from the disk 22 which extends at least approximately horizontally which means without being effected by the disk 22. The measuring screen 60 is illuminated by the light beam reflected by the reflector 10 without effect by the disk 22 in a region designated 62, which is bounded above by the horizontal light-dark boundary 63, which extends approximately below the horizontal plane HH.

The light beam reflected collectively by the reflector 10 comprises several light beam parts, which are reflected by different parts of the reflector 10. Two first light beam parts, which are on different sides of the vertical plane 18 and are at least partially symmetric to it, are reflected by a first part of the reflector 10. This first part of the light beam illuminates the measuring screen 60 inside of the region 62 in the first parts 64*a* and 64*b*, which are arranged on both sides of the vertical central plane VV under and adjacent to boundary lines 65*a* and 65*b* inclined to the horizontal light-dark boundary 63. The boundary lines 65*a* and 65*b* originate from the horizontal light-dark boundary 63 in the vicinity of vertical plane 18 and are inclined downward toward the edges of the measuring screen 60. The angle α between the respective boundary lines 65*a*, 65*b* and the horizontal light-dark boundary 63 amounts to from about 0° to 20°, advantageously about 15°. The angle α can be equal on both sides of the vertical central plane VV or different. A second light beam part is reflected from the second portion of the reflector 10. This second light beam part illuminates the measuring screen 60 inside of the region 62 in a second part 66 extending between the light-dark boundary 63 and the boundary lines 65*a* and 65*b*. The first and second light beam parts can overlap partially so that the second light beam part illuminates the part 66 and also the part 64*a* and 64*b* under the boundary lines 65*a* and 65*b*. The first light beam part however does not illuminate the region 66 above the boundary lines 65*a* and 65*b*. A third light beam part is reflected by a third part of the reflector. The third light beam part illuminates the measuring screen 60 inside of the region 62 in a third part 67 which is under the first part 64*a* and 64*b*.

The reflector 10 of the low-beam headlight according to a first embodiment is provided with a light-permeable disk 22 arranged in front of it as shown in FIG. 2. The light rays of the light beam reflected from the reflector 10 according to a first embodiment are not inverted, which means that the measuring screen 60 is illuminated right of its vertical central plane VV by the right part of the light beam reflected by the part of the reflector 10 to the right of the vertical plane 18. Correspondingly the measuring screen 60 is illuminated to the left of its vertical central plane VV by part of the light beam reflected by the part of the reflector 10 to the left of the vertical plane 18.

The first parts of the light beam illuminating the measuring screen 60 in the first parts 64*a*, 64*b* are reflected by first parts 34*a* and 34*b* of the reflector 10, which extend downward below the horizontal plane 16 from the boundary planes 35*a* and 35*b* which are inclined to the horizontal plane 16 according to the boundary lines 65*a*, 65*b* of the parts 64*a* and 64*b*. The boundary planes 35*a* and 35*b* originating from the optical axis 11 are inclined downward at an angle α relative to the horizontal plane 16 which is between about 0° to 20°, advantageously about 15°. The angles α on both sides of the vertical plane 18 can be equal or different. The first part 34*a*,34*b* of the reflector 10 extends under the boundary planes 35*a*,35*b* in its lateral edge regions to the lower edges of the reflector 10. The second part of the light beam illuminating the screen 60 in the part 66 is produced by the second part 36 of the reflector 10 which extends above and adjacent to the boundary planes 35*a*,35*b*. The second part 36 of the reflector 10 extends above the horizontal plane 16 and in the lateral edge regions of the reflector 10 reaches its upper edge. The part of the light beam illuminating part 67 of the measuring screen 60 is formed by reflection from the third part 37 of the reflector 10, which extends under the horizontal plane 16 adjoining the first part 34*a*,34*b* in the vicinity of the vertical plane 18 and which extends above the horizontal plane 16 adjacent the second part 36 in the vicinity of the vertical plane 18. The third part 37 extends to the lower and/or upper edges of the reflector 10.

The disk 22 has several zones in which optical elements of different effectiveness are located and through which the different parts of the light beam reflected by the reflector 10 pass. If the low-beam headlight is used for right-hand traffic in Europe, then the light beam issuing from it must illuminate a region 76 of the measuring screen according to FIG. 4. The region 76 is bounded above by a light-dark boundary, which has a substantially horizontal section 73 on the on-coming traffic side, which means the left side of the screen 60, and which has a portion 75 originating from the horizontal section 73 climbing toward the right edge of the measuring screen on its own traffic side which means the right side of the screen 60. For left-hand vehicle traffic the light beam issuing from the low-beam headlight must have the form shown in FIG. 4 with dashed lines in which there is a horizontal section 73' on the right side of the measuring screen 60 and a section 75' climbing to the edge of the screen 60 on the left side of the measuring screen 60.

The disk 22 has a first zone 44*a* in the embodiment for right-hand traffic which is arranged left of the vertical plane 18 as seen in the light propagation direction 20 and through which the first part of the light beam reflected by the first part 34*a* of the reflector 10 arranged to the left of the vertical plane 18 as seen in the light propagation direction 20 passes. At least one part of this first part of the light beam is shifted by the optical elements 24 located in the first zone 44*a* so that it is inclined upward to the right along the boundary line 65*a* and in such a way that it is partially scattered to produce the climbing section 75 of the light-dark zone. The disk 22 has another zone 46, through which the first part of the light beam reflected from the first part 34*b* of the reflector located right of the vertical plane 18 passes and the second and third part of the light beam reflected from the second and third parts 36 and 37 of the reflector 10 pass. The zone 46 has different parts, through which the different light beams pass. The portions of the light beam passing through the optical elements 24 located in the zone 46 are at least partially scattered in a substantially horizontal direction along the section 73 of the light-dark boundary. Another portion of this part of the light beam is used for formation of a light intensity maximum and not or only weakly scattered which means concentrated. A deflection of the other section of the first part of the light beam and the second and third part of the light beam reflected by the reflector 10 in a vertical direction by the optical elements 24 of the zone 46 is not necessary, since this is already below the horizontal section 73 of the light-dark boundary. The parts of the light beam passing through the optical elements 24 into the zone 46 are also made more uniform so that no undesirable local light intensity reductions are present inside the illuminated region 76 on the measuring screen 60. The light beam issuing from the low-beam headlight has a sufficient lateral scattering so that the region 76 has a substantially greater horizontal extent relative to the light beam reflected by the reflector 10 which has not been acted on by the disk 22 according to FIG. 3. Several lines 77 of equal illumination intensity, the so-called isolux lines, are shown in the region 76 in FIG. 4. The light intensity maximum in the region 76 is near the HV point and somewhat below it, for right-hand traffic somewhat to the right and for left-hand traffic somewhat to the left of it. Sufficiently high intensity is present just below the sections 73 and 75 of the light-dark boundary so that the light-dark boundary remains sharp. The arrangement of the zone 44*a* of the disk 22 shown in FIG. 2 is only exemplary and is generally arranged according to where the first part of the light beam reflected by the first part 34*a* of the reflector 10 passes through the disk 22.

The individual parts of the light beam reflected by the different parts 34*a*, 34*b*, 36 and 37 of the reflector 10 overlap advantageously at least in the plane in which the disk 22 is arranged, not, so that as previously mentioned the individual parts of the light beam are separated by the optical elements 24 arranged in the different zones and scattered in different directions. Because of that, it is guaranteed that the disk 22 is not warmed too much which is especially significant when the disk 22 is made of plastic.

When the low-beam headlight is used for left-hand traffic the first part of the light beam reflected by the first part 34*b* of the reflector 10 arranged to the right of the vertical plane 18 as seen in the light propagation direction 20 passes through a first zone 44*b* of the modified disk 22 which is arranged right of the vertical plane 18 and shown with dashed lines in FIG. 2. At least one part of this first part of the light beam is scattered by the optical elements 24 arranged in the first zone 44*b* of the disk 22 so as to be inclined to the left along and above the boundary line 65*b* so that the climbing section 75' for the light-dark boundary is produced. The zone 44*a* of the disk 22 does not appear in this modified embodiment of the disk 22 and instead of that the zone 44*b* is provided. By the remaining zone 46 of the disk 22 the first part of the light beam reflected by the first part 34*a* of the reflector arranged right of the vertical plane 18 and the parts of the light beam reflected from the remaining parts of the reflector pass through and are partially scattered in a substantially horizontal direction along the section 73' of the light-dark boundary by the optical elements 24 and are partially concentrated to form the light intensity maximum.

A second embodiment of the low-beam headlight according to the invention is shown in FIG. 5. In this low-beam headlight the reflector 110 is provided with a light-permeable disk 22 in front of it. The light rays of the light beam reflected from the reflector 11*o*0*n* according to the second embodiment are inverted, which means that the measuring screen 60 is illuminated left of its vertical central plane VV by part of the light beam reflected from that part of the reflector 110 which is to the right of the vertical plane 18. Similarly the measuring screen 60 is illuminated right of its vertical central plane VV by the part of the light beam reflected from that part of the reflector 110 which is to the left of the vertical plane 18.

In this second embodiment the first part of the light beam illuminating the first part 64*a*,64*b* of the measuring screen 60 is reflected by the first part 134*a*,134*b* of the reflector 110, which extends above the horizontal plane 16 from the boundary planes 135*a*,135*b*, which are inclined to the horizontal plane 16 according to the boundary lines 65*a*,65*b* of the first part 64*a*,64*b* of the measuring screen 60. The first part of the light beam reflected by the portion 134*a* of the first part 134*a*,134*b* of the reflector 110 left of the vertical plane 18 illuminates the portion 64*b* of the first part 64*a*,64*b* of the measuring screen 60 right of the vertical central plane VV and the first part of the light beam reflected from the portion 134*b* of the first part 134*a*,134*b* of the reflector 110 right of the vertical plane 18 illuminates the portion 64*a* of the first part 64*a*,64*b* of the measuring screen 60 left of the vertical central plane VV. The boundary planes 135*a*,135*b* extend from the optic axis 11 upwardly inclined at an angle $\alpha$ to the horizontal plane 16. The angle $\alpha$ is between about 0° to 20°, advantageously is about 15°. The angles $\alpha$ formed on both sides of the vertical plane 18 by the different boundary planes 134*a*,134*b* can be equal or somewhat different. The first part 134*a*,134*b* of the reflector lion above the boundary planes 135*a*,135*b* extends in the lateral edge regions of the reflector 110 to the upper edge of the reflector 110. The second part of the light beam illuminating the second part 66 of the measuring screen 60 is reflected by the second part 136 of the reflector 110, which extends under and adjacent to the boundary planes 135*a*,135*b*. The second part 136 of the reflector 110 extends under the horizontal plane 16 and reaches the lower edges of the lateral edge regions of the reflector 110. The third part of the light beam illuminating the third part 67 of the measuring screen 60 is reflected by a third part 137 of the reflector 110, which extends in the vicinity of the vertical plane 18 above the horizontal plane 16 adjacent to the first part 134*a*,134*b* and which also extends under the horizontal plane 16 in the vicinity of the vertical plane 18 adjacent to the second part 136. The third part 137 extends to and between the upper and lower edge of the reflector 110.

The disk 22 has a first zone 144*b* arranged right of the vertical plane 18 as seen in the light propagation direction 20 in the embodiment or variant for right-hand traffic, through which the first part of the light beam reflected by the first portion 134*b* of the first part 134*a*,134*b* of the reflector 110 to the right of the vertical plane 18 passes. At least one part of this first part of the light beam is scattered by the optical elements 24 arranged in the first zone 144*b* of the disk 122 inclined upwardly along the boundary line 64*a* on the measuring screen 60 so that it produces the climbing section 75 of the light-dark boundary according to FIG. 4. The disk 122 has another zone 146, through which the first part of the light beam reflected by the portion 134*a* of the first part 134*a*,134*b* of the reflector 110 arranged left of the vertical plane 18 and the parts of the light beam reflected from the remaining parts of the reflector 110 passes. Light is partially scattered along the section 73 of the light-dark boundary in a horizontal direction by the optical elements 24 arranged there and is partially concentrated to form the illumination intensity maximum. A deflection of the other first part of the light beam and the second and third part of the light beam reflected from the reflector 110 in a vertical direction is not required of the optical elements 24 of the zone 146, since light from these optical elements 24 is already located under the horizontal section 73 of the light-dark boundary according to FIG. 4. The part of the light beam emerging from the optical elements 24 of the zone 146 is furthermore made uniform so that no undesirable local variations of the illumination intensity are present inside the illuminated region 76 on the measuring screen 60. The light beam emerging from the low-beam headlight has a sufficient lateral scattering so that the region 76 has a substantially greater extent in comparison to the region 62 illuminating the measuring screen 60 according to FIG. 3 by the light beam reflected by the reflector 110 without action of the light-permeable disk 122.

In the application of the low-beam headlight for left-hand traffic the light-permeable disk 122 has a zone 144*b* shown with dashed lines in FIG. 5 instead of the previously described zone 144*a* which is arranged to the left of the vertical plane 18 as seen in the light propagation direction 20. The first light beam reflected by the first portion 134*a* of the first part 134*a*,134*b* of the reflector 110 left of the vertical plane 18 as seen in light propagation direction 20 passes through the first zone 144*b*. At least one part of this first part of the light beam is scattered by the optical elements 24 arranged in the first zone 144*b* of the disk 122 inclined upwardly to the left along the boundary line 65*b* so that it produces the climbing portion 75' of the light-dark boundary shown in FIG. 4. The first part of the light beam reflected by a portion 134*b* of the first part 134*a*,134*b* right of the vertical plane 18 and parts of the light beam reflected by the remaining part of the reflector pass through the remaining zone 146 of the disk 122 and are partially scattered substantially horizontally by the optical elements 24 arranged in that zone and partially concentrated to form an illumination intensity maximum. The arrangements of the first zones 144*a*,144*b* of the disk 122 shown in FIG. 5 are only exemplary and generally arranged according to where the first part of the light beam reflected by the first part 134,134*b* of the reflector 110 passes through the light-permeable disk 122.

A light concentration under the boundary line 65*a*,65*b* on at least one of both sides of the vertical plane VV is provided in both previously described embodiments of the low-beam headlight by the first part of the light beam reflected from the first part 34*a*,34*b* and/or 134*a*/134*b* of the reflector 10 and/or 110. This light concentration is according to choice at least partially scattered by one of the zones 44*a*,44*b* and/or 144*a*,144*b* of the light-permeable disk 22 and/or 122 along the climbing portion 75 and/or 75' of the light-dark boundary. Because of that, a sufficiently high light intensity is provided under the climbing sections 75 and/or 75' of the light-dark boundary and the sections 75 and/or 75' is formed so that they are sharp. A light concentration under the horizontal light-dark boundary 63 is produced by the second part of the light beam reflected by the second parts 35 and/or 136 of the reflector 10 and/or 110, which then is scattered horizontally by the zones 46 and/or 146 of the disk 22 and/or 122 so that also a sufficiently high light intensity is present under the horizontal section 73 and/or 73' of the light-dark boundary and the section 73 and/or 73' is formed so that it is sharp and a light intensity maximum or illumination intensity maximum results.

The boundary lines 65*a*,65*b* of the first part 64*a*,64*b* of the measuring screen 60 illuminated by the first part of the light beam from the first part 34*a*,34*b* and/or 134*a*,134*b* of the reflector 10 and/or 110 can extend approximately horizontally with spacing below the light-dark boundary 63. Accordingly the boundary planes 35*a*,35*b* and/or 135*a*,*b* of the first part 34*a*,34*b* and/or 134*a*,*b* of the reflector 10 and/or 110 extend approximately horizontally above or below the horizontal plane 16.

Figure 6:
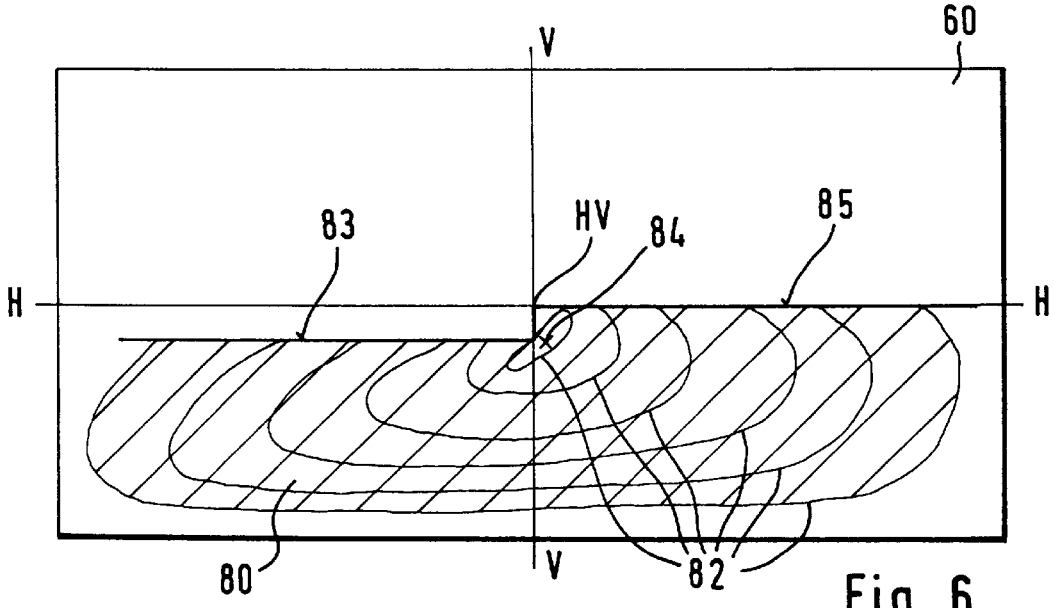
FIG. 6 is a diagrammatic plan view of an additional pattern of light formed on the measuring screen by a light beam from another embodiment of the headlight.

The measuring screen is shown in FIG. 6 with an illuminated region 80 on it, as it must be illuminated by the light beam issuing from the low-beam headlight according to the standard usage in the USA. The region 80 is bounded above by a light-dark boundary, which has a first approximately horizontal central plane HH on the on-coming traffic side, which means the left side of the measuring screen 60 for right-hand traffic. The light-dark boundary has a second approximately horizontal section 85 which is somewhat higher than the first horizontal section 83, for example approximately at the height of the horizontal central plane HH, on its own traffic side, which means the right side of the measuring screen 60. The reflector 10 and/or 110 of the low-beam headlight is formed according to one of the above-described embodiments and only the disk 22 and/or 122 is modified so that the measuring screen 60 is illuminated according to FIG. 6 in the region 80 in which several isolux lines 82 are shown. The reflector 10 and/or 110 has therefore different partial regions, by which the parts of the light beam are reflected, which illuminate the parts of the measuring screen 60 shown in FIG. 3. Thus the parts of the light beam are reflected by the selected parts of the reflector, which illuminate the part 66 of the measuring screen 60 under the light-dark boundary 63 according to FIG. 3. One of the parts of the light beam passes through one of these associated zones of the disk and is scattered upward and to the right by the optical elements there so that a first part of the light beam illuminates the measuring screen 60 according to FIG. 6 under the second horizontal section 85 of the light-dark boundary. The parts of the light beam reflected by the remaining parts of the reflector are partially scattered by the optical elements arranged in the remaining zones of the disk in a substantially horizontal direction along the first horizontal section 83 of the light-dark boundary and partially concentrated to form an illumination intensity maximum. The light intensity or illumination intensity maximum 84 is thus present in the region approximately to the right and besides the HV point.

Figure 4:
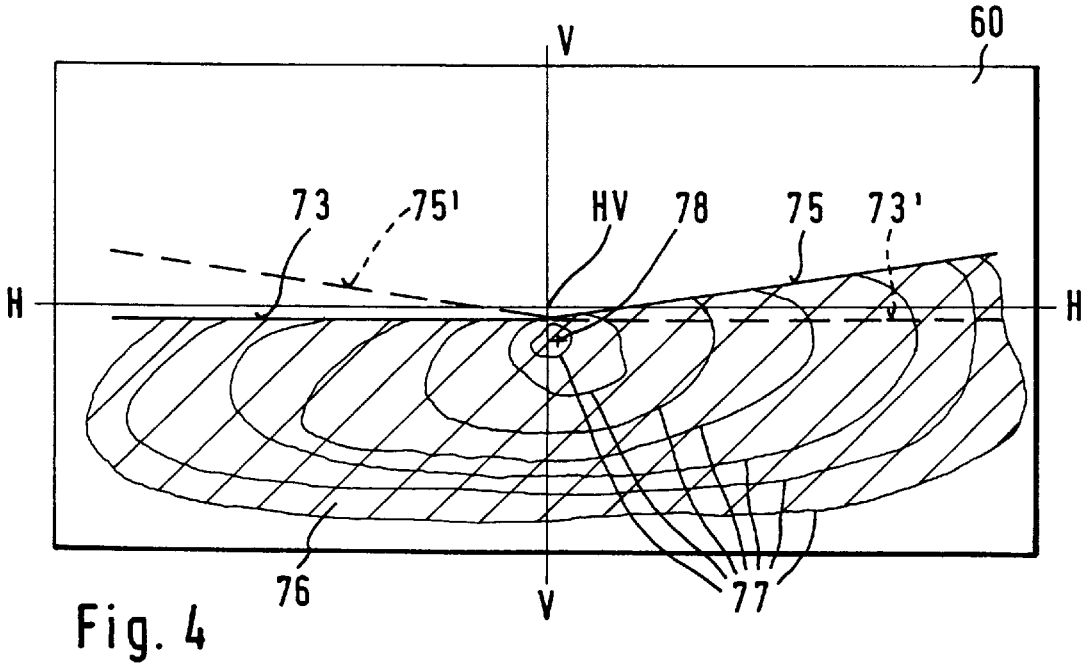
FIG. 4 is a diagrammatic plan view of another pattern of light formed by a light beam from the headlight on the measuring screen.

In use of the low-beam headlight for right-hand traffic or left-hand traffic in Europe, where the measuring screen 60 is required to be illuminated by the light beam from the headlight as shown in FIG. 4, and in use of the low-beam headlight for right-hand traffic in the USA, where the measuring screen 60 is required to be illuminated by the light beam from the headlight as shown in FIG. 6, always the same reflector 10 and/or 110 can be used. In the low-beam headlight according to the invention it is only necessary to change the light-permeable disk 22 and/or 122 to adapt the headlight to the differing requirements of right-hand and left-hand traffic and usage in different countries.

Different portions of the measuring screen according to FIG. 3 are illuminated by different parts of the reflector 10 and/or 110. These different portions of the measuring screen 60 are correlated with different parts of the reflector 10 and/or 110, by which different parts of the light beam are reflected which illuminates these different parts of the measuring screen 60. The form of each part of the reflector 10 and/or 110 is determined from the laws of reflection, so that the parts of the light beam reflected by each part of the reflector is correctly reflected in the correct direction. The individual parts of the reflector 10 and/or 110 pass continuously into each other so that the reflector as a whole is continuous, which means that it is free of discontinuities and steps and can be simply manufactured.

The disclosure of German Patent Application 1 96 10 904.3 of Mar. 20, 1996 is incorporated here by reference. This German Patent Application also describes the instant invention and is the basis for a claim of priority for the instant invention as claimed hereinbelow under 35 U.S.C. 119.

While the invention has been illustrated and described as embodied in a low-beam headlight for a vehicle, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A low-beam headlight for a vehicle comprising a reflector (10; 110), a light source (12) and a light-permeable disk (12; 122) arranged in the path of light rays reflected from the light source by the reflector and having optical elements (24), whereby a light beam is formed from the light rays and has an asymmetric light-dark boundary with a section (73; 73'; 83) directed toward an on-coming traffic side of the vehicle and another section (75; 75'; 85) directed toward a traffic side of the vehicle opposite to the or-coming traffic side so that the section of the light-dark boundary on said traffic side of the vehicle opposite the oncoming traffic side of the vehicle opposite the on-coming traffic side is at least partially higher than said section directed toward the on-coming traffic side of the vehicle;

wherein the reflector (10; 110) includes means for reflecting light from the light source to form one of said light beams which forms an approximately horizontal light-dark boundary on a measuring screen arranged in front of the low-beam headlight without action of the light-permeable disk (12; 122) and the optical elements (24) of the light-permeable disk (12; 122) extend substantially over an entire surface of the light-permeable disk (12; 122) and includes means (24) for at least partially deflecting a portion of the light beam reflected from the reflector (10; 110) to form said section (75; 75'; 85) of the light-dark boundary (63) on said traffic side of said vehicle opposite from the on-coming traffic side.

2. The low-beam headlight for a vehicle as defined in claim 1, wherein the means for reflecting light forms two first parts of said light beam on opposite sides of a vertical plane (18) containing an optic axis (11) of the reflector (10; 110) and extending at least approximately symmetrically to said vertical plane (18) and the means for at least partially deflecting of said light-permeable disk (22; 122) deflects only one of said two first parts of said light beam so as to produce said section (75; 75'; 85) of said light-dark boundary (63) associated with said traffic side of said vehicle opposite to said on-coming traffic side.

3. A low-beam headlight for a vehicle comprising a reflector (10; 110), a light source (12) and a light-permeable disk (12; 122) arranged in the path of light rays reflected from the light source by the reflector and having at least one localized optical element (24), whereby a light beam is formed from the light rays and has asymmetric light-dark boundary with a section (73; 73'; 83) directed toward an oncoming traffic side of the vehicle and another section (75; 75'; 85) directed toward a traffic side of the vehicle opposite to the on-coming traffic side so that the section of the light-dark boundary on said traffic side of the vehicle opposite the on-coming traffic side is at least partially higher than said section directed toward the on-coming traffic side of the vehicle;

the reflector (10; 110) includes means for reflecting light from the light source to form one of said light beams which forms an approximately horizontal light-dark boundary on a measuring screen arranged in front of the low-beam headlight without action of the light-permeable disk (12; 122) and the at least one optical element (24) of the light-permeable disk (12; 122) includes means for at least partially deflecting a portion of the light beam reflected from the reflector (10; 110) to form said section (75; 75'; 85) of the light-dark boundary (63) on said traffic side of said vehicle opposite from the on-coming traffic side; the reflector (10; 110) has a reflector part (34*a*, 34*b*; 134*a*; 134*b*) by which said first part (64*a*, 64*b*) of said measuring screen (60) having a boundary line (65*a*, 65*b*; 165*a*, 165*b*) at least partially extending below and spaced from said horizontal light-dark boundary (63) without action of the light-permeable disk (22, 122), and said reflector (10; 110) has a second reflector part (36; 136) by which a second part of the light beam is reflected which illuminates a second part (66) of the measuring screen (60) bordering said horizontal light-dark boundary (63) without action of the light-permeable disk (22, 122).

4. The low-beam headlight for a vehicle as defined in claim 3, wherein the reflector (10; 110) is formed so that the boundary line (65*a*,65*b*) of the horizontal light-dark boundary (63) is inclined relative to the horizontal light-dark boundary (63).

5. The low-beam headlight for a vehicle as defined in claim 4, wherein the reflector (10; 110) is formed so that the boundary line (65*a*,65*b*) extends in an inclined manner from a vertical central plane (VV) of the measuring screen (60).

6. The low-beam headlight for a vehicle as defined in claim 4, wherein said section (75; 75') of the light-dark boundary is inclined relative to said section (73; 73') of the light dark boundary associated with the on-coming traffic side of the vehicle and said boundary lines (65*a*,65*b*) extend inclined to at least the same degree as the section (75; 75') associated with the traffic side of the vehicle opposite to the on-coming traffic side.

7. The low-beam headlight for a vehicle as defined in claim 3, wherein the second reflector part (36; 136) extends to the boundary planes (35*a*,35*b*; 135*a*,135*b*) in the vicinity of a horizontal plane (16) passing through the reflector and containing the optic axis (11) of the reflector (10; 110) and the boundary planes (35*a*,35*b*; 135*a*,135*b*) extend at least partially with spacing from the horizontal plane (16) and said first reflector part (34*a*,34*b*; 134*a*,134*b*) extends adjacent the second reflector part (36; 136) on one side of the boundary planes (35*a*,35*b*; 135*a*,135*b*) opposite from another side on which the second reflector part is located.

8. The low-beam headlight for a vehicle as defined in claim 7, wherein the boundary planes (35*a*,35*b*; 135*a*,135*b*) separating the first reflector part (34*a*,34*b*; 134*a*,134*b*) and the second reflector part (36, 136) extend approximately according to the boundary lines (65*a*,65*b*) separating said first part (64*a*,64*b*) and said second part (66) of the measuring screen (60) illuminated by the first and second parts of the light beam without action of the light-permeable disk (22, 122).

9. The low-beam headlight for a vehicle as defined in claim 8, wherein the reflector (10; 110) has a third reflector part (37; 137) extending adjacent to at least one of the first reflector part (34*a*,34*b*; 134*a*,134*b*) and the second reflector part (36; 136), said third reflector part (37; 137 reflects a third part of the light beam which illuminates a third part (67) of the measuring screen (60) which is arranged next to and below the first part (64*a*,64*b*) of the measuring screen (60).

10. The low-beam headlight for a vehicle as defined in claim 3, wherein the light-permeable disk (22; 122) has a first zone (44*a*,44*b*; 144*a*,144*b*) including the at least one optical element (24) through which a portion of the light beam reflected by the first reflector part passes and is deflected by the at least one optical element (24) of said disk (22; 122) so that said section (75; 75'; 85) of the light-dark boundary (63) associated with said traffic side of the vehicle opposite to the on-coming traffic side is produced, and wherein the light-permeable disk (22; 122) has another zone (46) including the at least one optical element (24) through which a remaining portion of the light beam reflected by the reflector passes and the remaining portion is at least partially scattered by the at least one optical element (24) in a substantially horizontal direction along said section (73, 73'; 83) of the light-dark boundary (63) associated with said on-coming traffic side of the vehicle.

11. The low-beam headlight for a vehicle as defined in claim 10, wherein the first parts of the light beam passing through the first zone (44*a*,44*b*; 144*a*,144*b*) of the light-permeable disk (22; 122) are at least partially scattered along the section (75; 75'; 85) of the light-dark boundary (63) by the at least one optical element (24) arranged there.

* * * * *